US006206015B1

(12) United States Patent
Ramsey

(10) Patent No.: US 6,206,015 B1
(45) Date of Patent: Mar. 27, 2001

(54) INTERIOR TANK CLEANING APPARATUS

(76) Inventor: Donald Ramsey, 962 Cornell Ave., Youngstown, OH (US) 44502

( * ) Notice: Subject to any disclaimer, the term of this patent is extended or adjusted under 35 U.S.C. 154(b) by 0 days.

(21) Appl. No.: 09/238,910

(22) Filed: Jan. 28, 1999

(51) Int. Cl.[7] ..... B08B 3/02

(52) U.S. Cl. ..... 134/167 R; 134/169 R; 134/166 R

(58) Field of Search ..... 134/166 R, 167 R, 134/168 C, 167 C, 169 C, 166 C, 169 R, 172, 181; 15/104.13

(56) References Cited

U.S. PATENT DOCUMENTS

| | | | | |
|---|---|---|---|---|
| 1,806,127 | * | 5/1931 | Staley . | |
| 2,017,042 | | 10/1935 | Dougherty . | |
| 2,461,517 | * | 2/1949 | Carnevale . | |
| 2,748,944 | * | 6/1956 | Kalinske | 134/167 R |
| 3,071,107 | | 1/1963 | Stanley . | |
| 3,106,491 | | 10/1963 | Leibner . | |
| 3,358,935 | * | 12/1967 | Andersen | 134/167 R |
| 3,449,783 | | 6/1969 | Kirschke . | |
| 3,487,841 | * | 1/1970 | Goodrum | 134/167 R |
| 3,880,359 | * | 4/1975 | Novy | 134/168 R |
| 3,994,310 | | 11/1976 | Brandon . | |
| 4,206,313 | | 6/1980 | Cavoretto . | |
| 4,212,248 | * | 7/1980 | Mybury | 134/167 C |
| 4,559,960 | | 12/1985 | Lanier . | |
| 4,690,159 | | 9/1987 | Vadakin et al. . | |
| 5,038,810 | * | 8/1991 | Pacheco et al. | 134/167 R |
| 5,113,885 | | 5/1992 | Ramsey . | |
| 5,444,887 | | 8/1995 | Rufolo . | |
| 5,829,461 | | 11/1998 | Ramsey . | |

FOREIGN PATENT DOCUMENTS

| | | | | |
|---|---|---|---|---|
| 3405391 | * | 9/1984 | (DE) | 15/105.31 |
| 764752 | * | 9/1980 | (RU) | 134/167 R |

* cited by examiner

*Primary Examiner*—Frankie L. Stinson
(74) *Attorney, Agent, or Firm*—Harpman & Harpman

(57) ABSTRACT

An apparatus for cleaning the interior of tanks or the like, the apparatus has high pressure rotary fluid distribution nozzles on rotating arms that adjustably extend from a movable platform to follow the varying dimensions of a tapered interior surface of a tank to be cleaned. The apparatus is self-centering within the enclosure with high pressure fluid swivels and quick disconnect air and fluid supply fittings associated therewith.

10 Claims, 11 Drawing Sheets

INTERIOR TANK CLEANING APPARATUS

BACKGROUND OF THE INVENTION

1. Technical Field

This device relates to tanks and pipe cleaning devices that travel through the interior of a tank cleaning the interior surface as they go. These types of devices use mechanical and/or fluid under high pressure to shower the interior surface of debris and are usually pulled through the interior by an auxiliary means.

2. Description of Prior Art

Prior art devices of this type have relied on a variety of structures having multiple cleaning heads on guide and support structures that position the cleaning heads in contact with the surface to be cleaned. See for example U.S. Pat. Nos. 2,017,042, 3,449,783, 3,071,107, 3,994,310, 3,106,491, 4,206,313, 4,559,960, 4,690,159, 5,113,885 and 5,444,887.

In U.S. Pat. No. 2,017,042 a pipe painting machine is disclosed having a support frame with a pair of spring actuated brushes and extension arms with adjustable guide legs having rollers thereon.

U.S. Pat. No. 3,071,107 is directed towards a pipe coating apparatus having power paint rollers on a rotating support assembly that is self-propelled through a pipe.

U.S. Pat. No. 3,106,491 claims a pipe cleaning and coating apparatus having multiple guide rails and an annular discharge nozzle spray pattern as it is pulled through the pipe by an ancillary transportation source.

In U.S. Pat. No. 3,449,783 a hydraulic waste disposal line cleaner is disclosed having a high pressure source of fluid with jet propulsion means that drives the tool forward into the waste disposal line utilizing cleaning pressure fluid.

U.S. Pat. No. 3,994,310 is directed to a duct cleaning apparatus having a pair of fluid nozzles rotatably positioned on a support and supply arm with guide strips extending therefrom.

U.S. Pat. No. 4,206,313 on a pipe cleaning nozzle having multiple skids to space a nozzle body within a pipe. High pressure fluid is discharged propelling the nozzle through the pipe.

A sewer cleaning apparatus is disclosed in U.S. Pat. No. 4,559,960 wherein a wheeled carriage is pulled through the sewer line with a scrapping disk mechanically engaging the interior walls as it goes.

U.S. Pat. No. 4,690,159 is directed towards a rotary cleaning device having rotary spray heads with a pair of outlet nozzles on arms extending therefrom.

Applicant's own U.S. Pat. No. 5,113,885 discloses a pipe cleaning apparatus wherein a support platform carries and positions a rotating centrally positioned spray nozzles as the assembly is pulled through the pipe.

U.S. Pat. No. 5,444,887 discloses an under water pipe cleaning device having scrapper blades carried by a support frame that is pulled through the pipe.

Applicant's earlier U.S. Pat. No. 5,829,461 discloses the basic interior cleaning apparatus from which the present improvement evolved. Its primary elements, such as spray arm support hub assembly and leg assembly structure provide for a pipe and tank cleaning device for use in fixed interior pipes and tank dimensions.

SUMMARY OF THE INVENTION

A cleaning device for tanks to remove deposits and worn coatings from the interior surface thereof. The cleaning device uses ultra high pressured water dispensed from multiple nozzle heads on rotating extension arms that are adjustably positioned for engagement on diverging interior surface of a tapered tank interior configuration to be cleaned.

DESCRIPTION OF THE PREFERRED EMBODIMENT

Figure 1:
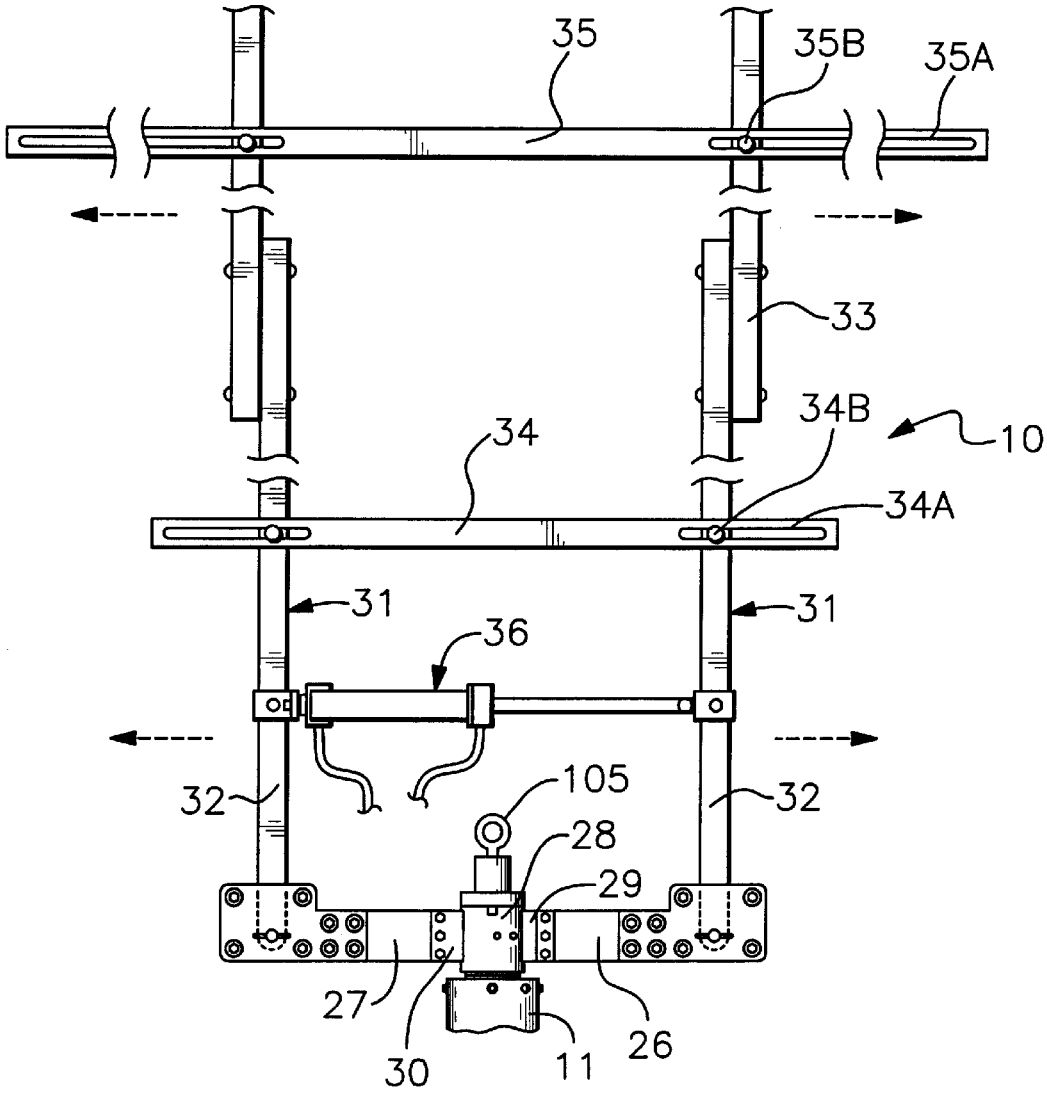
FIG. 1 is a top plan view of a portion of the adjustable spray arms support assembly of the invention.

Referring to FIGS. 1–3, 8 and 8A of the drawings, an improved tank cleaning device 10 can be seen having a main support body member 11 with multiple annularly disposed guide leg assemblies 12–14 extending therefrom. A spacing tube 15 extends from said body member 11 to a support hub 16 which has a second set of multiple annularly disposed leg assemblies 17, 18 and 19 extending therefrom.

Figure 3:
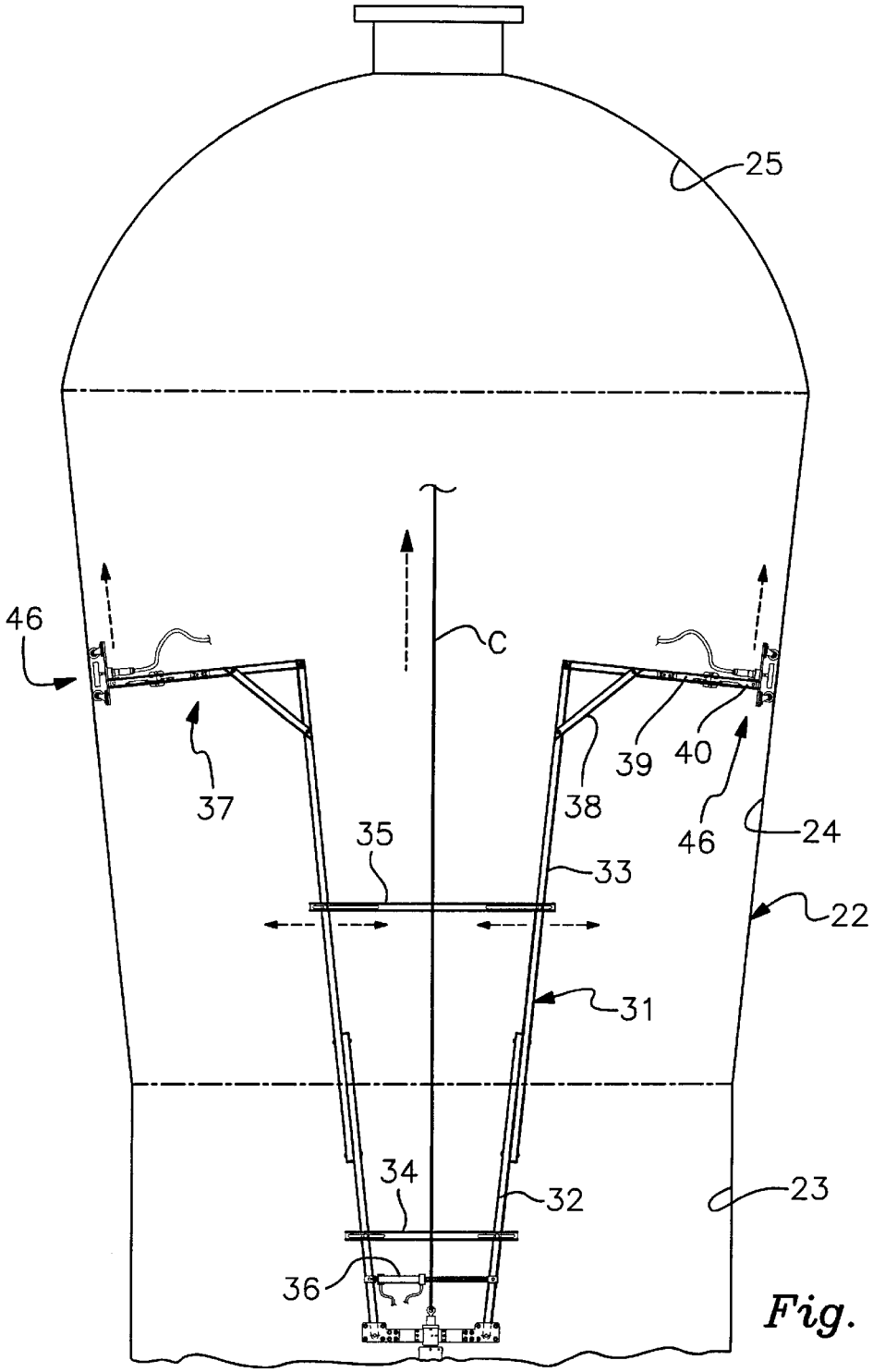
FIG. 3 is a illustration of a tapered tank portion to be cleaned with the adjustable interior tank cleaning apparatus of the invention positioned within and engaged therewith.
Figure 10:
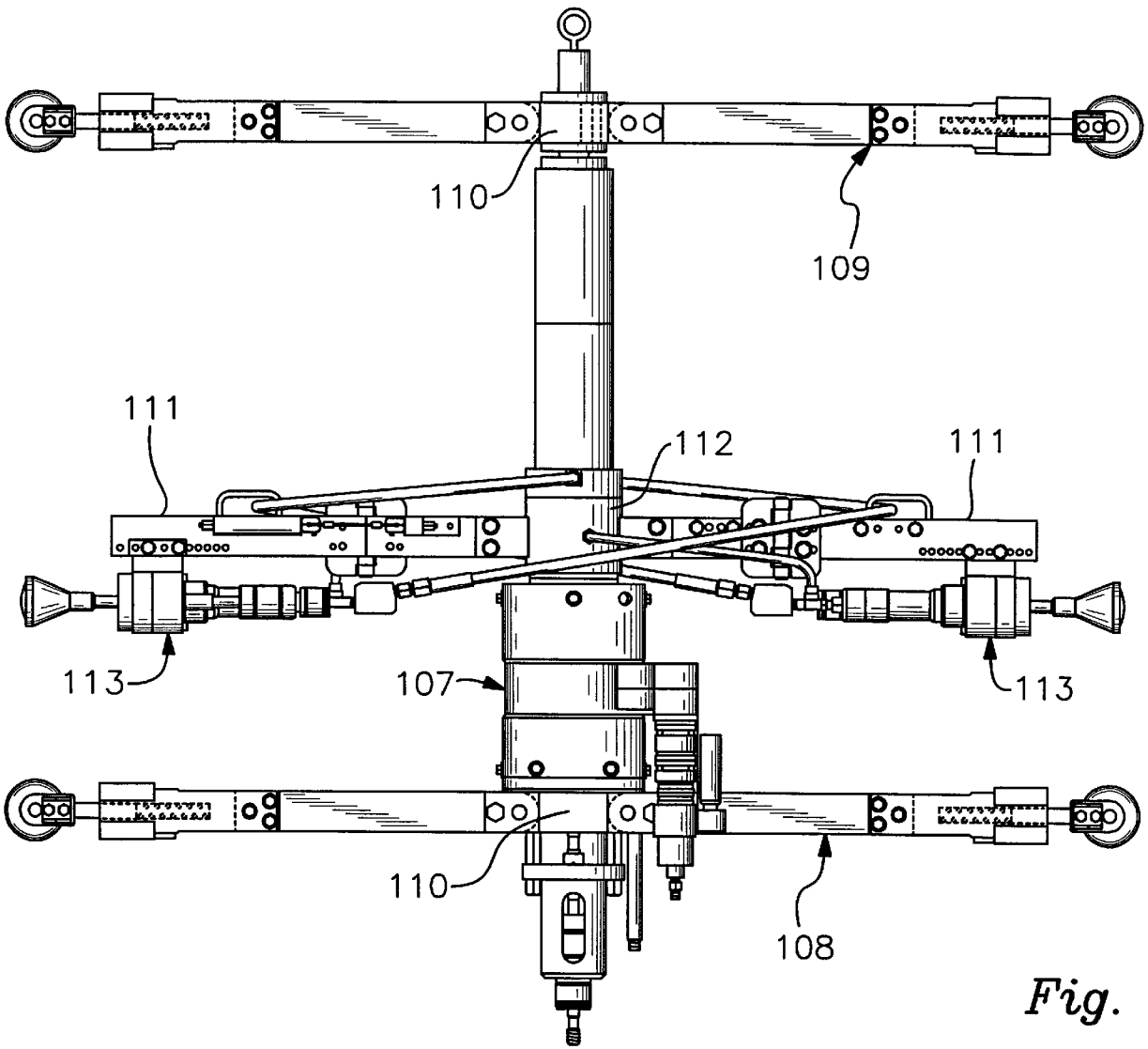
FIG. 10 is a top plan view of an alternate form of the cleaning device of the invention adapted for large fixed dimensional interior tank surfaces.

Each of the leg assemblies 12–14 and 17–19 has an adjustable leg bar 20 with a self-centering spring loaded wheel assemblies 21 secured to their respective free ends by multiple fasteners as will be well understood by those skilled in the art. The leg assemblies 12–14 and 17–19 self-center within a tank 22 having a cylindrical interior surface 23 and a conical transition surface 24 with a dome enclosure surface 25 as shown in FIGS. 3 and 10 of the drawings. It will be apparent that as the spring loaded leg assemblies 12–14 and 17–19 correspondingly engage the interior cylindrical surface 23 of the tank 22, the main support body member 11 is thus "centered" within as best seen in FIG. 8A of the drawings.

A pair of oppositely disposed mounting brackets 26 and 27 extend from a rotating spray arm hub assembly 28 on the main support body member 11 which will be described in greater detail hereinafter. Each of the mounting brackets 26 and 27 are secured to the arm hub 28 by respective apertured lugs 29 and 30 thereon. Spray arm extension bar assemblies 31 are pivotally secured inwardly from the respective free ends of the mounting brackets 26 and 27.

Each of the spray arm extension assemblies 31 has a pair of interconnected tubular arm elements 32 and 33 with a pair of longitudinally spaced guide limit bars 34 and 35 extending therebetween. The guide limit bars 34 and 35 are slotted at 34A and 35A inwardly from their respective free ends for registration with restriction pins 34B and 35B.

A pneumatic piston and cylinder assembly 36 is pivotally secured to said respective arm extension assemblies 31 between said guide limit bar 34 and the mounting brackets 26 and 27. Accordingly, upon activation of the pneumatic piston and cylinder assembly 36 the respective arm extensions 31 will pivot away from one another until the limits of the respective guide limit bars 34 and 35 are engaged as is generally illustrated in FIG. 3 of the drawings.

Figure 2:
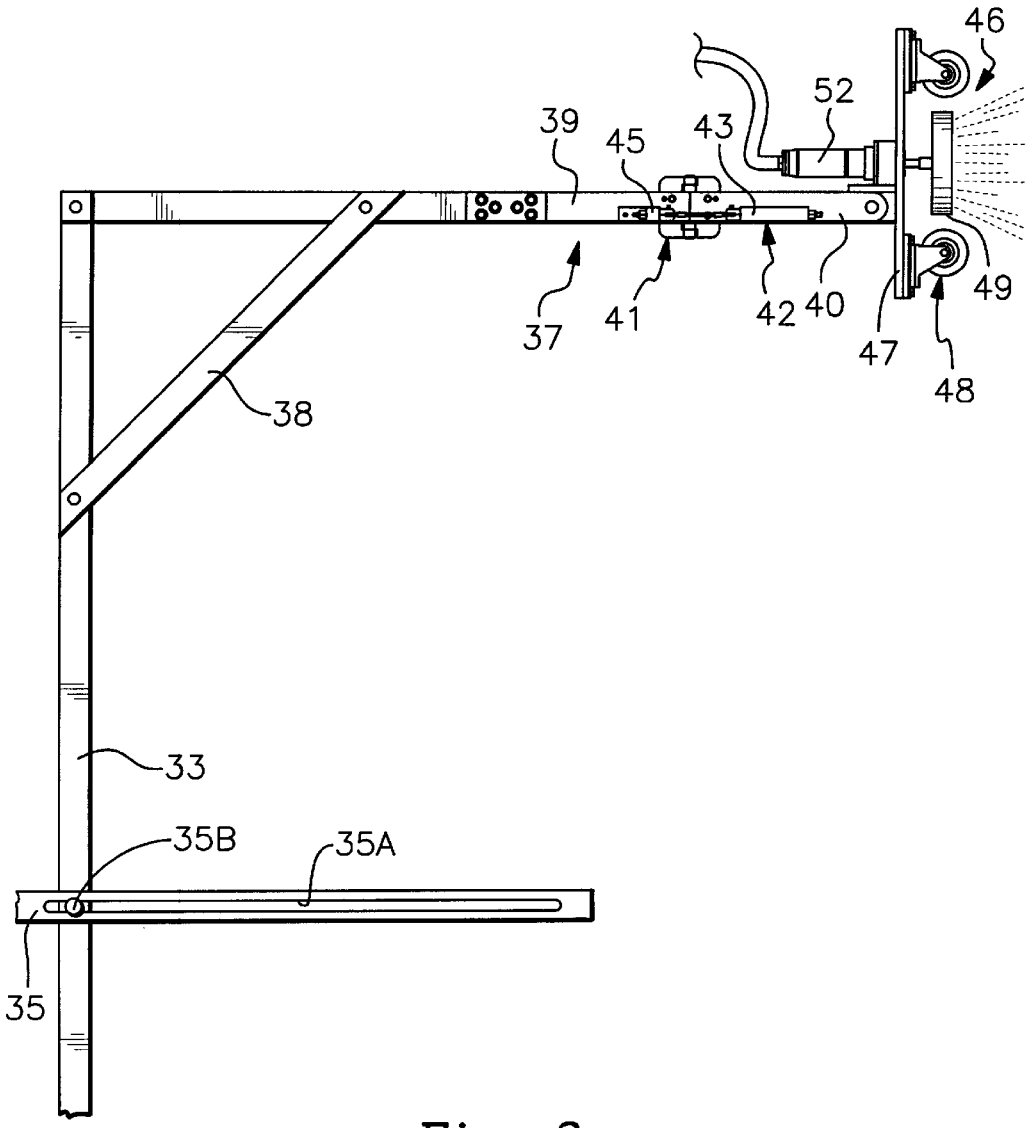
FIG. 2 is a top plan view of an adjustable spray arm support assembly and spray head tank engagement assembly.
Figure 7:
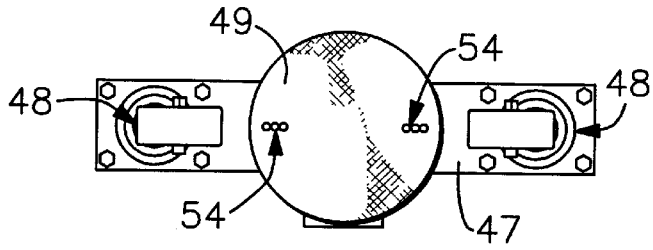
FIG. 7 is an end plan view of the cleaning device nozzle support head assembly portion illustrated in FIG. 5 of the drawings.
Figure 5:
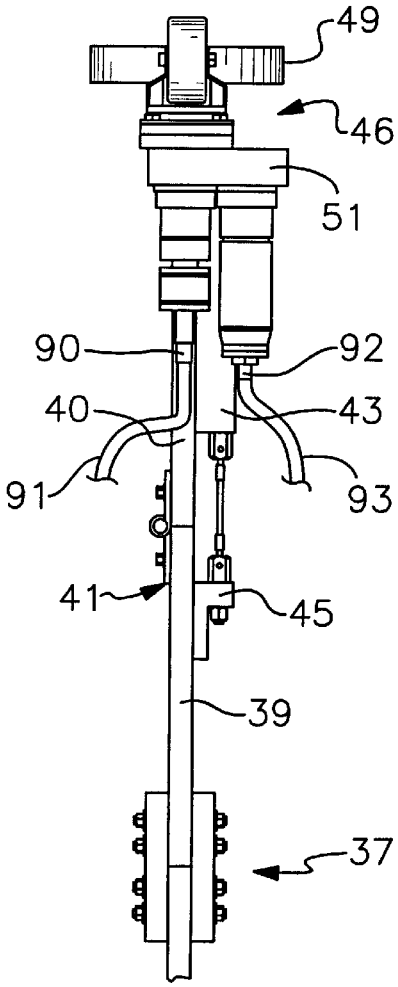
FIG. 5 is a front elevational view of the cleaning nozzle support head assembly of the invention.
Figure 6:
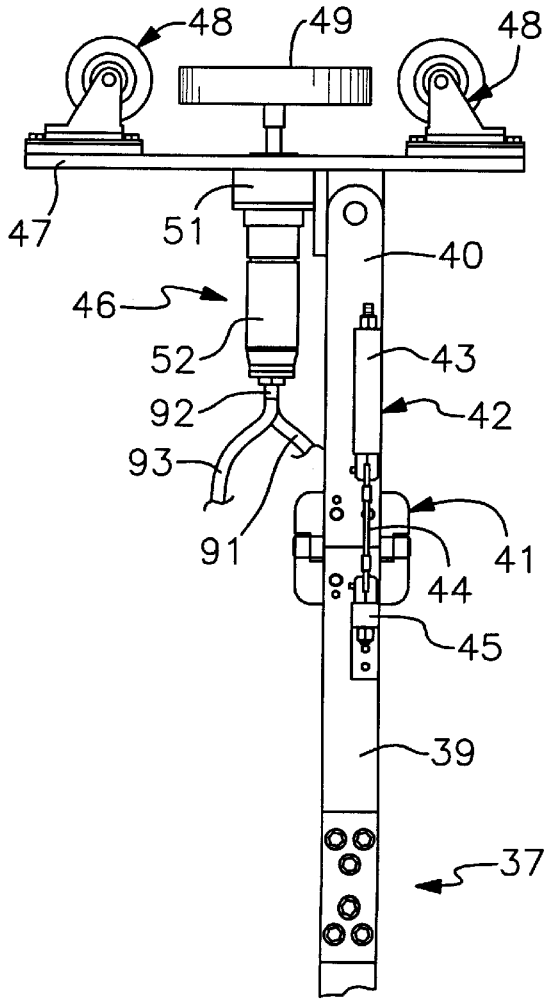
FIG. 6 is a side elevational view of the cleaning device nozzle support head assembly portion illustrated in FIG. 5 of the drawings.

Referring now to FIG. 2 of the drawings, a cleaning arm assembly 37 can be seen that extends at right angles from the distal ends of the respective spray arm extension 33 with an angle brace 38 extending therebetween. Each of the cleaning arm assemblies 37 have first and second support bars 39 and 40 hinged together by a hinge assembly 41. A spray arm tensioning assembly 42 extends longitudinally between the support bars 39 and 40 adjacent the hinge 41. The tension assembly 42 has a spring housing fitting 43 on the support bar 40 from which a spring urged cable 44 extends therefrom, as will be well understood by those skilled in the art, to an engagement fitting 45 on the first support bar 39 opposite said hinge side of the bars maintaining the respective support bars 39 and 40 in an extended open relationship. A nozzle mounting assembly 46 is adjustably positioned on the free ends of the respective cleaning arm assemblies 37 as best seen in FIGS. 5, 6, and 7 of the drawings. Each of the nozzle mounting assemblies 46 has an apertured mounting plate 47 with oppositely disposed engagement swivel mounted wheels 48 thereon. A high pressure spray head 49 extends from an aperture between the wheels 48 and is connected with high pressure fluid swivel 50 and a source of fluid under pressure. A sealed gear reduction box 51 driven by an air motor 52 rotates the nozzle assembly 49 which has a main spray head 53 with a plurality of aligned spaced nozzles 54 in pairs thereon, as best seen in FIG. 7 of the drawings.

Referring now to FIG. 3 of the drawings, it will be evident from the above description that the respective nozzle assemblies 46 will track on the inside surface 24 of a tank 22 to be cleaned as the cleaning device 10 of the invention is advanced through the tank 22 by a pull cable C as will be understood by those skilled in the art.

Figure 4:
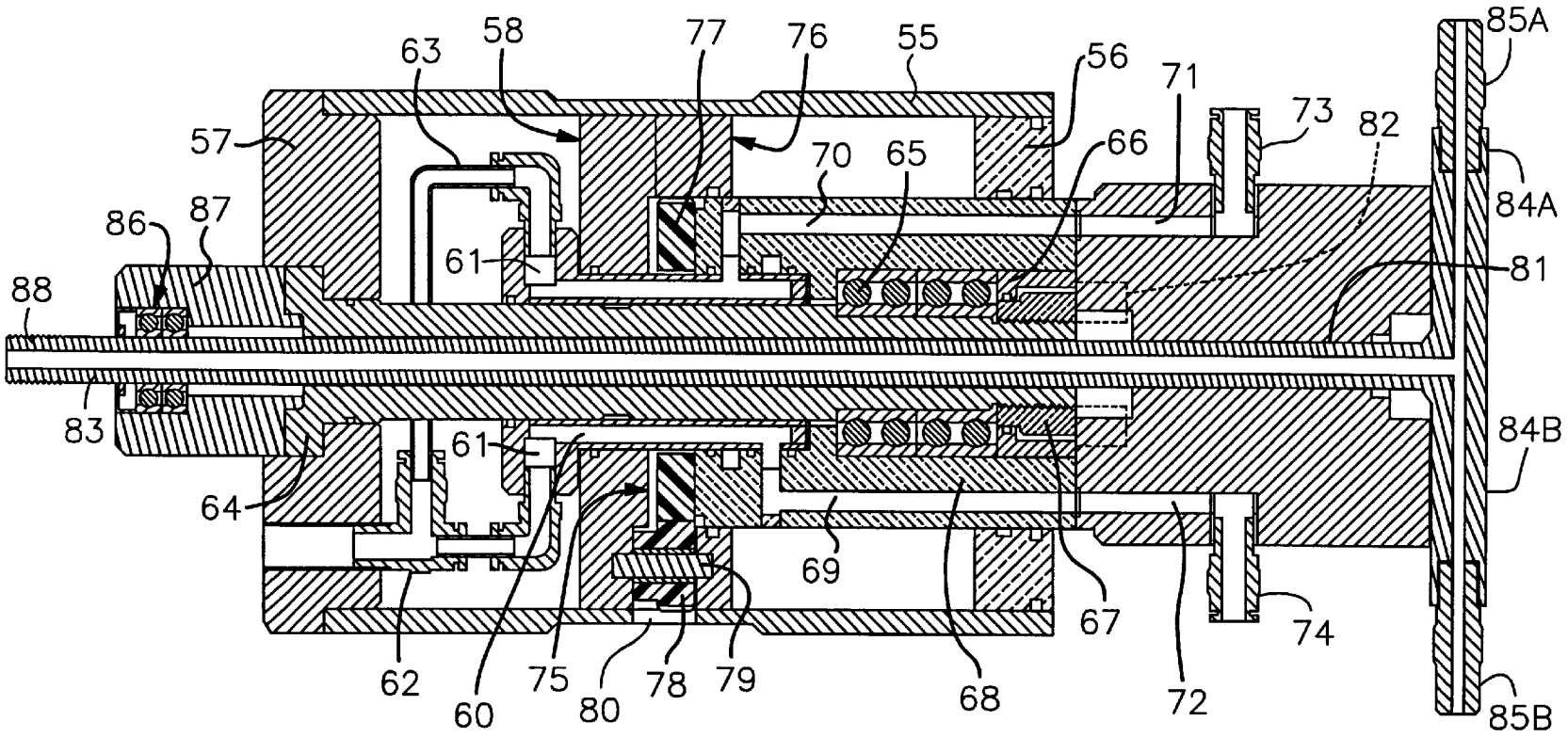
FIG. 4 is a cross-sectional view of the improved cleaning device of the invention.

Referring now to FIG. 4 of the drawings, the main support body member 11 can be seen having a cylindrical housing 55 with a front bushing 56 at oppositely disposed apertured end cap 57 with an apertured center support fitting 58 therebetween. An air swivel fitting assembly 59 is positioned within the central fitting 58 having an annular air passage 60 with multiple air inlet ports 61 therein. An air supply fitting 62 with associated interconnected piping 63 extends from the apertured end cap 57 to the air inlet ports 61. An apertured central shaft 64 is registerably positioned through the respective end cap 57 and the air swivel fitting assembly 59 hereinbefore described. A pair of bearing assemblies 65 are positioned on the central shaft 64 by a bearing retainer 66 and a shaft nut 67 threadably disposed thereon. The bearing assembly 65 rotatably position the spray arm support hub assembly 28 having a bearing engagement portion 68 within the cylinder housing 55.

The spray arm's support hub assembly 28 has longitudinally extending air channels 69 and 70 and the arm hub assembly 28 extending from the cylindrical housing 55. The arm hub assembly 28 has longitudinally extending air channels 71 and 72 therein that are in communication with the air channels 69 and 70 respectively; with outlet ports and connector fittings 73 and 74 respectively.

The central support fitting 58 forms the lower half of a head gear drive box enclosure 75 with an upper half 76 defining the gear box enclosure 75 which has a main drive gear head 77 within. An idler gear 78 on a shaft 79 engages the main drive gear 77 and is accessible by an opening at 80 in the main support body member 11 as will be explained in greater detail hereinafter.

The arm hub assembly 28 having a central bore 81 therethrough is aligned for engagement and secured to the bearing engagement portion by interconnecting pins 82 and fasteners extending through registering openings therein. A high pressure fluid feed pipe 83 is rotatably positioned through the central bore of the center shaft 64 and has a T-shaped outlet ends at 84A and 84B with respective high pressure fluid couplings 85A and 85B thereon. A pipe support bearing assembly 86 is positioned in a pipe and rear leg support fitting 87 extending from the end of the central shaft 64. The free end of the fluid feed pipe 83 is externally threaded at 88 to registerably receive a fluid swivel assembly 89 best seen in FIG. 8 of the drawings. Fluid couplings 90 and flexible fluid supply lines 91 interconnect the fluid's swivels 89 with the hereinbefore described high pressure spray heads 53.

Air fittings 92 and flexible air supply lines 93 interconnect the air couplings 73 and 74 with the air motors 52 on the respective cleaning arm assemblies 33.

The fluid swivel assembly 89 was illustrated and described in applicant's U.S. Pat. No. 5,829,461 and is incorporated by reference hereto. The fluid swivel assemblies 50 and 89 provides a high pressure fluid swivel for the improved cleaning device of the invention.

Figure 8:
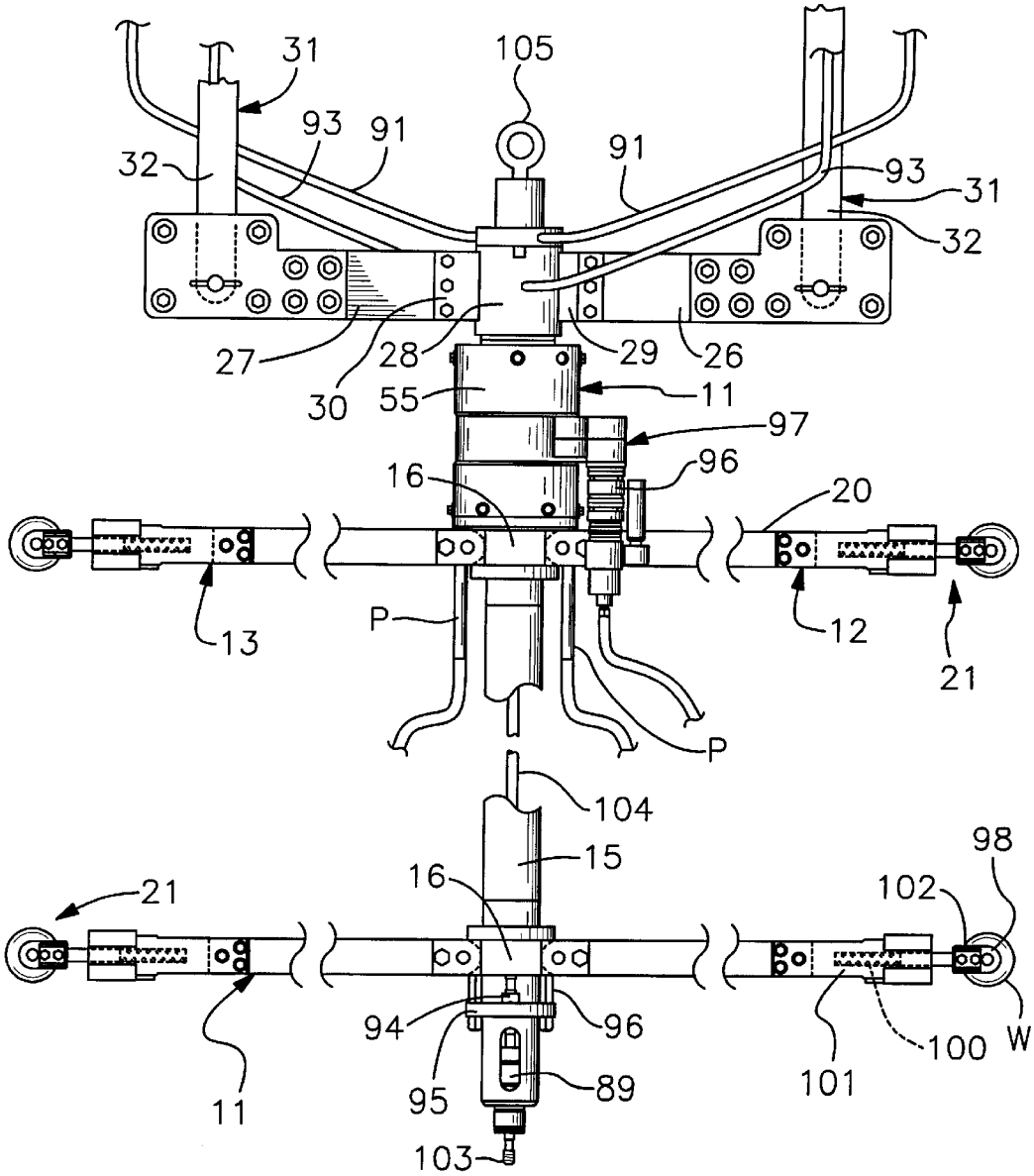
FIG. 8 is a top plan view of the support and centering portion of the improved cleaning device of the invention with portions broken away for illustration purposes.
Figure 8A:
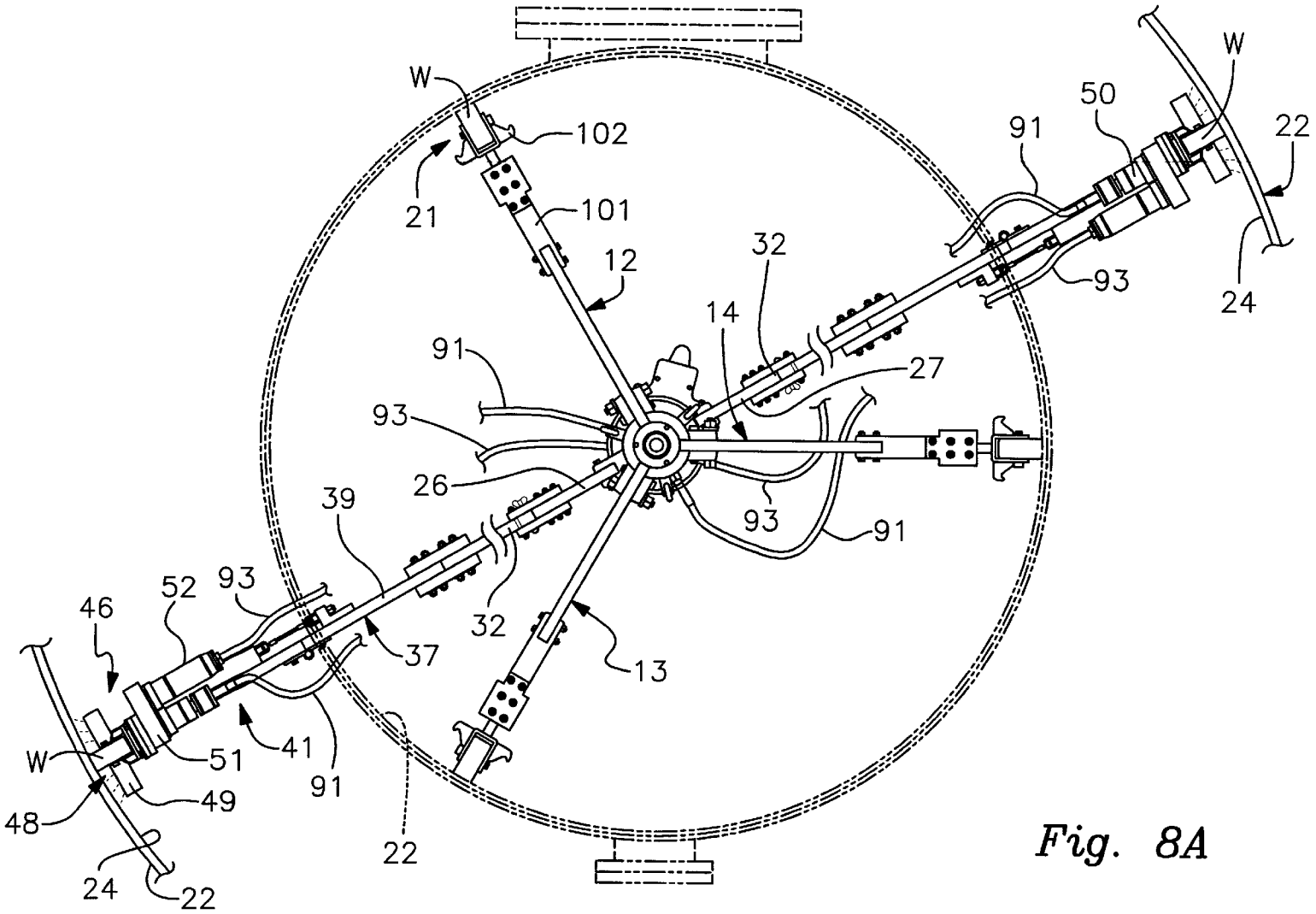
FIG. 8A is an elevational view of the interior cleaning device of the invention within a tank portion to be cleaned.

Referring to FIG. 8 of the drawings, the fluid swivel 89 is interconnected to the inlet end of the fluid feed pipe 83 by a coupling and is positioned in a support bracket 95 extending from a rear leg mounting assembly that extends from the hub extension 16 hereinbefore described.

The tank cleaning device 10 of the invention is shown having a main air drive motor 96 and a drive gear assembly housing 97 mounted on the cylindrical housing 55 so as to be registerable within the idler gear 78 through the opening 80 in the main support body so as to rotate the spray arm hub assembly 28 and spray arm extension assemblies 81 interconnected thereto as hereinbefore described. Each of the self-centering spring loaded wheel assemblies 21 has a bifurcated mounting bracket 98 holding a wheel W extending from a support rod 99 engaged against a spring insert 100 within a mounting bracket 101 and are secured to the respective ends of the wheel leg assemblies on each of the adjustable leg bars 20.

Retaining clamps 102 are provided to effectively retract the wheel W into the end of the respective leg assemblies 101 as set forth in applicant's U.S. Pat. No. 5,829,461 incorporated by reference.

Figure 9:
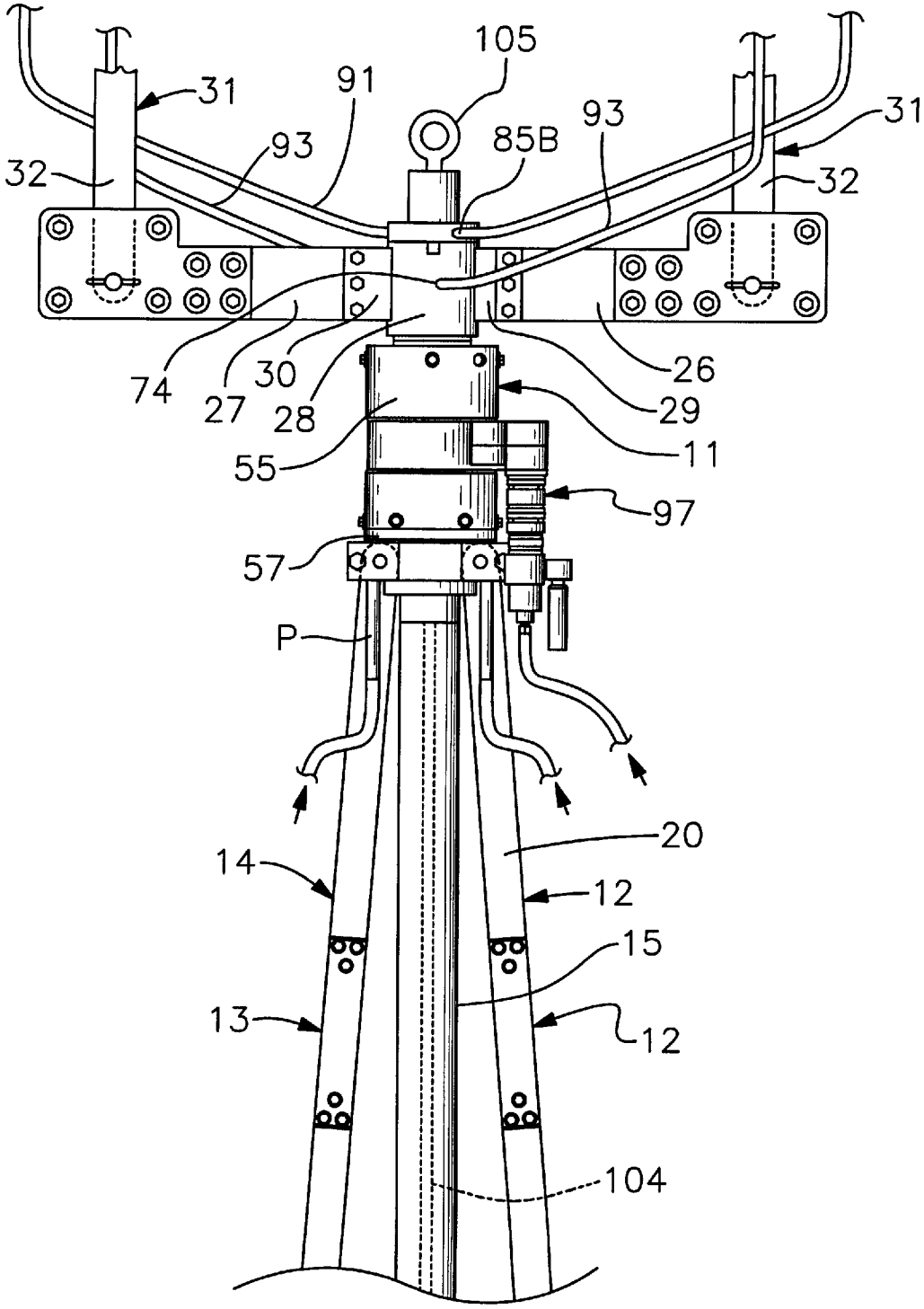
FIG. 9 is a partial top plan view of the support and centering portion of the cleaning device with parts broken away in folded transportable position.
Figure 9A:
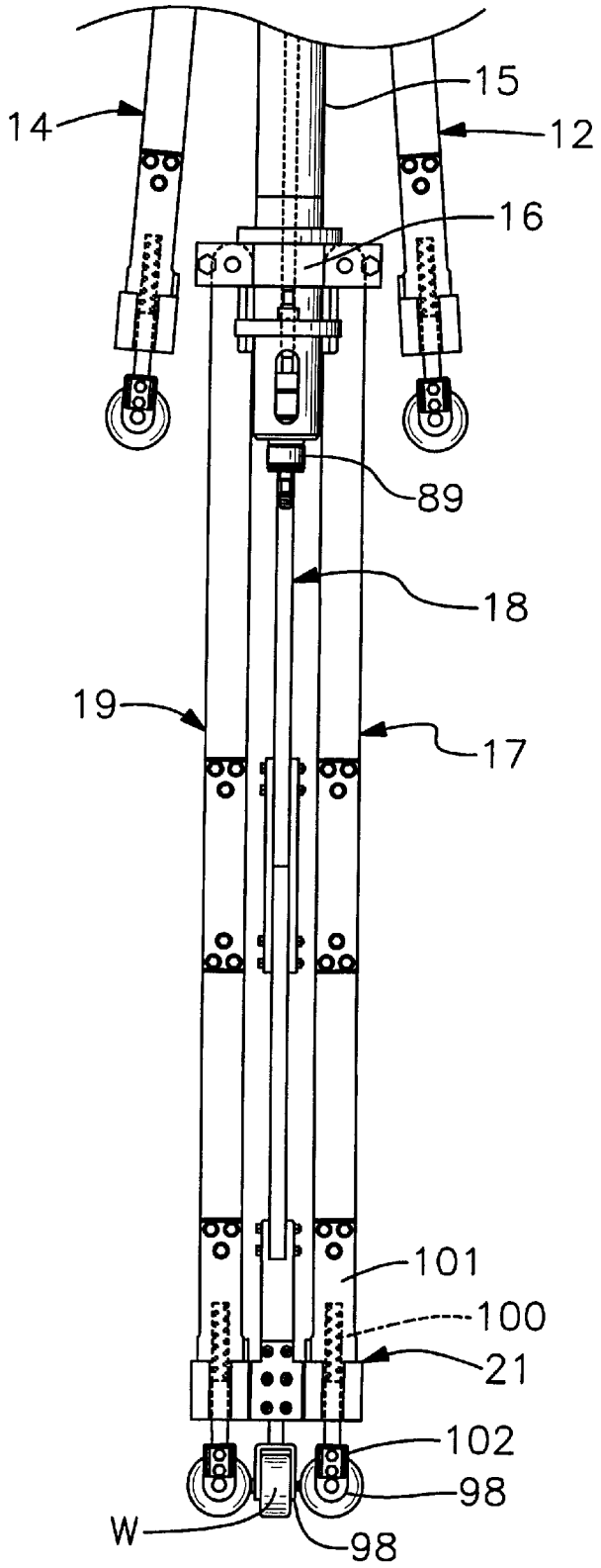
FIG. 9A is a partial top plan view of the support and centering portion of the cleaning device in folded transportable position.

Referring now to FIGS. 3, 9 and 9A of the drawings, it will be evident that to deploy the tank cleaning device of the invention within the tank 22 the respective support leg assemblies 12–14 and 17–19 can be removed and/or are pivoted downwardly as illustrated parallel along the main body member 11 with the respective assembly fluid supply lines being disconnected if required for insertion into the tank.

Once inserted within the tank 22, the respective leg assemblies 12–14 and 17–19 are deployed and the spring loaded wheel fittings 21 are on the respective ends are released by opening of the retraction clamps 102 so as to engage the interior surface 23 of the tank 22 thus stabilizing and centering the cleaning device 10 of the invention within the tank to be cleaned.

It will be evident that the cleaning head assemblies 46 on the rotating arm extension 31 will engage the interior surface 24 on the transition portion of the tank 22 and track upwardly being advanced outwardly by the pneumatic piston and cylinder assembly 36 which pivotally extends incrementally the respective arm assemblies 31 outwardly maintaining the contact of the cleaning head assemblies 46 with the tank's inner surface.

A source of cleaning fluid (water) under high pressure for cleaning purposes (not shown) is connected to an inlet 103 of the high pressure fluid swivel 89 providing fluid through a fluid feed pipe 104 and the fluid supply pipe 83 with respective oppositely disposed high pressure couplings 85A and 85B which are in turn interconnected by the respective high pressure fluid lines 91 and couplings to the fluid swivels 50 on the respective spray nozzle assemblies 46 on the respective support arm assemblies 31.

A source of air pressure (not shown) is connected to the inlet port (P) of the high pressure air fitting 61 and thus supplies the air swivel with air pressure within the annular air passage apertures at 60 and to the respective air channels 71 and 72 which in turn supply the outlet port 73 and 74 and respective quick release couplings of the invention.

The interconnecting air lines 93 extend from the respective couplings 74 and 75 to air motors 52 at the respective cleaning arm assemblies 46.

The cleaning device 10 of the invention is manually pulled through the tank 22 by the central cable C by an outside conveyance (not shown) connected to an engagement lug 105 on the front hub 14 thereof.

Referring now to FIG. 10 of the drawings, an alternate form of the tank cleaning device 106 can be seen having a main support body member 107 with a pair of oppositely disposed leg assemblies 108 and 109 extending therefrom. Each of the leg assemblies has a support hub 110 secured to the main support body member 107. A pair of spray arms 111 extend outwardly from a central support spray arm hub 112 each of which has a nozzle assembly 113 adjustably positioned on its end.

The leg assemblies have wheel fittings 114 on each respective end thereof which are identical to that illustrated and shown in the preferred form of the embodiment at 21 hereinbefore described.

In essence, the alternate form is a modified version of the preferred embodiment in which the spray head assemblies 113 are positioned between the respective support leg assemblies 108 and 109 and are in fact quite similar to applicant's earlier tank cleaning apparatus illustrated in U.S. Pat. No. 5,829,461 incorporated by reference herein.

Figure 11:
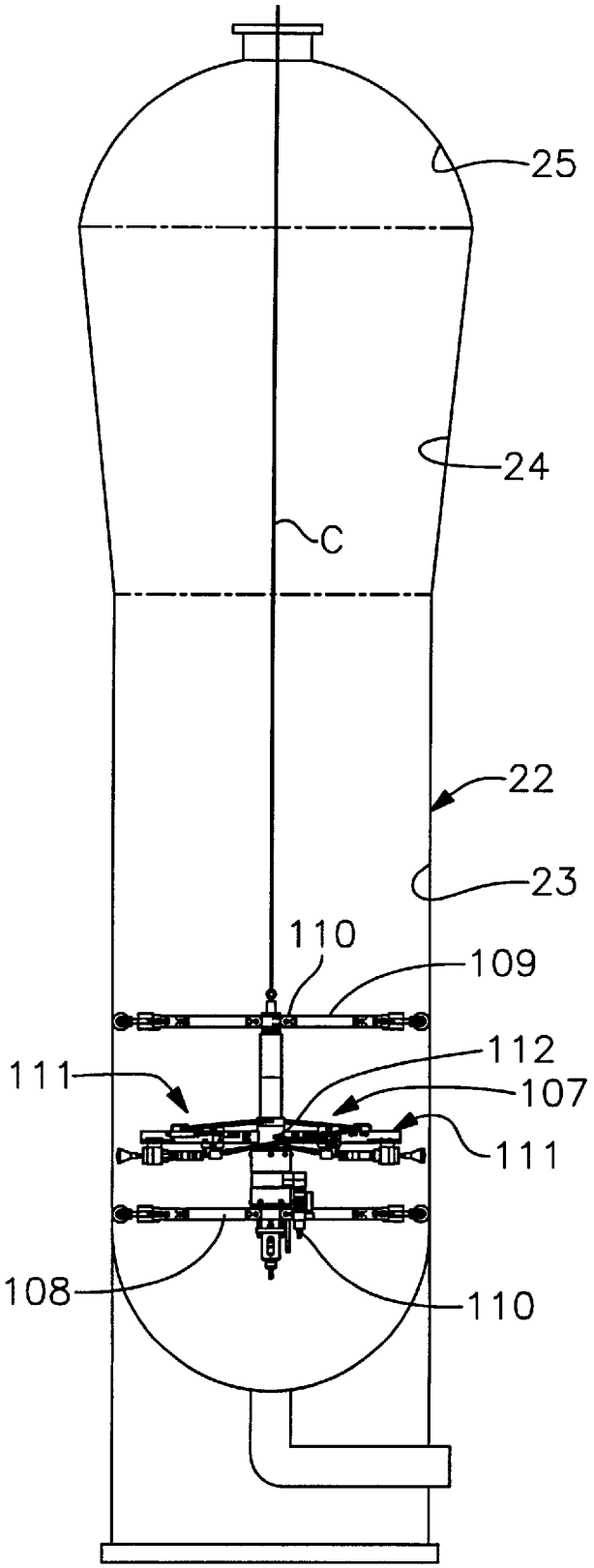
FIG. 11 is an illustrated view of a tank portion to be cleaned by the alternate form of the invention.

It is respectfully submitted that this modified form of the invention is appropriate to clean fixed portions of large tanks before reaching the tapered areas in which the preferred form of the embodiment of the invention and the improvement to the device is applicable as seen in FIG. 11 of the drawings.

Thus it will be seen that a new and novel improvement in a tank cleaning device has been illustrated and described that will provide effective cleaning for transitional surfaces of tanks and that various changes and modifications may be made therein without departing from the spirit of the invention.

Therefore I claim:

1. An apparatus for cleaning an interior surface of a tank comprising; a main support body having a front bushing and oppositely disposed apertured end cap thereon, multiple support leg assemblies extending from said main support body for engagement with said tank interior surfaces, a central shaft within said main support body, a support hub rotatably positioned on said central shaft, air supply channels in said main support body, a fluid supply pipe rotatably positioned within said central support shaft, spray arm extension assemblies pivotally secured to said support hub, cleaning arm assemblies extending from distal ends of said respective spray arm extension assemblies, spray nozzle assemblies on ends of said cleaning arm assemblies engageable on the interior surface of said tank, means for pivotally moving said respective spray arm extension assemblies away from one another to maintain said spray nozzle assemblies against said interior surface of said tank and guide means for said spray arm extension assemblies.

2. The apparatus set forth in claim 1 wherein said multiple leg assemblies comprises; mounting hubs, apertured legs extending from said hubs, leg bars extending from said legs, resilient wheel assemblies on the free ends of said respective leg bars and means for adjustably positioning said wheel assemblies thereto to center said main support body within the interior of said tank.

3. The apparatus set forth in claim 1 wherein said spray nozzle assemblies comprises; a mounting and support plate pivotally secured to the respective free ends of said cleaning arm assemblies, a rotatable spray head on said mounting and support plate, wheel means on said mounting and support plate for engaging said interior surface of said tank, means for rotating said spray head and means for interconnecting said spray head with a source of fluid under pressure.

4. The apparatus set forth in claim 3 wherein said means for rotating said spray heads comprises; an air motor and gear assembly on said respective nozzle assemblies and a source of air under pressure for said air motor.

5. The apparatus set forth in claim 3 wherein said means for interconnecting said spray head with a force of fluid under pressure comprises; a fluid swivel and supply lines extending therefrom to said fluid outlet ports on said support hub.

6. The apparatus set forth in claim 1 wherein each of said spray arm extension assemblies comprises; a pair of interconnecting tubular elements and said cleaning arm assemblies extend from oppositely disposed mounting brackets on said support hub.

7. The apparatus set forth in claim 1 wherein said cleaning arm assemblies extend at right angles from said spray arm extensions and comprises; a first support bar, and a second support bar, hinge assembly interconnecting said first and second support bars, and a tension cable assembly between said respective first and second support bars.

8. The apparatus set forth in claim 1 wherein said means for pivotally moving said respective spray arm extensions away from one another comprises; a piston and cylinder assembly pivotally secured to and between said spray arm extensions.

9. The apparatus set forth in claim 1 wherein said guide means for said spray arm extensions comprises; a first guide limit bar and a second guide limit bar, said guide bars having slots inwardly from their respective distal ends registerable with upstanding pin means in said respective spray arm extensions.

10. The apparatus set forth in claim 9 wherein said first guide limit bar is of a known length and said second guide limit bar is of a length greater than that of said first guide bar.

* * * * *